US006166999A

United States Patent [19]

Jujo et al.

[11] Patent Number: 6,166,999

[45] Date of Patent: Dec. 26, 2000

[54] CLOCK WITH A MAINSPRING WOUND STATE INDICATOR

[75] Inventors: Koichiro Jujo; Katsuyoshi Takizawa; Norio Shibiya, all of Chiba, Japan

[73] Assignee: Seiko Instruments Inc., Japan

[21] Appl. No.: 09/367,882

[22] PCT Filed: Dec. 22, 1998

[86] PCT No.: PCT/JP98/05788

§ 371 Date: Nov. 29, 1999

§ 102(e) Date: Nov. 29, 1999

[87] PCT Pub. No.: WO99/32942

PCT Pub. Date: Jul. 1, 1999

[30] Foreign Application Priority Data

Dec. 22, 1997 [JP] Japan ..... 9-353619

[51] Int. Cl.[7] ..... G04B 9/00; G04B 1/10; G04B 1/00

[52] U.S. Cl. ..... 368/66; 140/203

[58] Field of Search ..... 368/66, 140, 155, 368/203, 204

[56] References Cited

U.S. PATENT DOCUMENTS

| | | | |
|---|---|---|---|
| 588,373 | 8/1897 | Antoine . | |
| 1,191,525 | 7/1916 | Mazer . | |
| 4,500,213 | 2/1985 | Grimm | 368/208 |
| 5,699,322 | 12/1997 | Born | 368/66 |
| 5,828,628 | 10/1998 | Born et al. | 368/66 |

FOREIGN PATENT DOCUMENTS

| | | |
|---|---|---|
| 261346 | 11/1896 | France . |
| 1066074 | 6/1954 | France . |
| 43-24870 | 10/1968 | Japan . |
| 4-216490 | 8/1992 | Japan . |
| 9-21886 | 1/1997 | Japan . |

*Primary Examiner*—Vit Miska
*Attorney, Agent, or Firm*—Adams & Wilks

[57] ABSTRACT

To reduce a number of parts constituting a spring winding state display device and downsize a movement, a device including a first sun wheel installed with a first sun wheel gear 152 and a first sun wheel arbor 154. A second sun wheel 160 is provide with a second sun wheel gear 162 and a second sun wheel pinion 164. The second sun wheel gear 162 is in mesh with an intermediate ratchet wheel 140. A planetary reduction wheel gear 170 is in mesh with a barrel gear 126. A first planetary wheel 172 and a second planetary wheel 174 are rotatably arranged to a planetary reduction wheel gear 170 with centers of rotation thereof disposed at portions different from a center of rotation of the planetary reduction wheel gear 170. The first planetary wheel 172 rotates while revolving around the second sun wheel pinion 164. The second planetary wheel 174 rotates while revolving around the first sun wheel gear 152. A sun wheel finger 180 is attached to a third axle portion 154*c* such that it can slip.

8 Claims, 14 Drawing Sheets

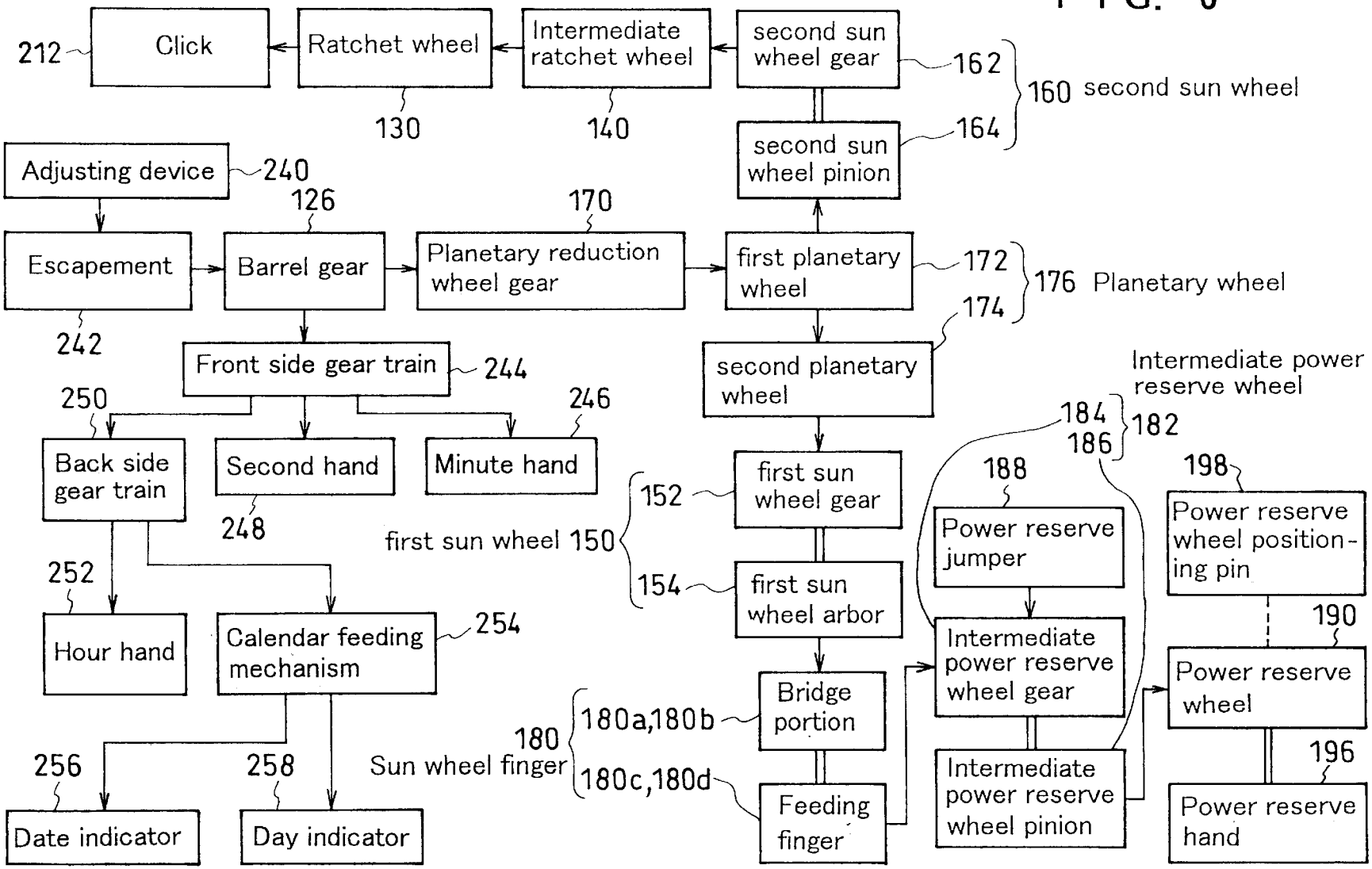
FIG. 6
160 second sun wheel
162
164
second sun wheel gear
second sun wheel pinion
Intermediate ratchet wheel
140
Ratchet wheel
130
Click
212
176 Planetary wheel
172
174
first planetary wheel
second planetary wheel
170
Planetary reduction wheel gear
Barrel gear
126
240
Adjusting device
Escapement
242
Front side gear train
244
Minute hand
246
Second hand
248
Back side gear train
250
Intermediate power reserve wheel
182
184
186
188
Power reserve jumper
Intermediate power reserve wheel gear
Intermediate power reserve wheel pinion
198
Power reserve wheel position-ing pin
190
Power reserve wheel
196
Power reserve hand
first sun wheel gear
152
first sun wheel arbor
154
first sun wheel 150
Bridge portion
Feeding finger
180a,180b
180c,180d
180
Sun wheel finger
Calendar feeding mechanism
254
Hour hand
252
Day indicator
258
Date indicator
256

CLOCK WITH A MAINSPRING WOUND STATE INDICATOR

TECHNICAL FIELD

The present invention relates to a timepiece with spring winding state display having a function of displaying a winding state of a spring which constitutes a power source of a mechanical type timepiece, particularly to a timepiece with spring winding state display mounted with a display device which is small-sized and easy to see by using a planetary gear mechanism.

BACKGROUND ART

In a mechanical type timepiece, there has been developed a mechanism to display of remaining time for which a spring can be operated, that is, to display a duration time period of the timepiece (power reserve mechanism). According to such a power reserve mechanism, there is used a planetary gear mechanism for reciprocating in a fan-like shape a hand for displaying the duration time period of the timepiece.

For example, there is disclosed a constitution of a timepiece with spring winding state display in JP-A-9-21886.

As shown in FIG. 14, such a conventional timepiece with spring winding state display is constituted by a ratchet wheel 1, a planetary reduction wheel gear 7 in mesh with a barrel complete 2, a planetary gear mechanism constituted by a planetary wheel 8 rotatably attached to an eccentric portion of the planetary reduction wheel gear 7, a sun wheel 6 in mesh with a planetary pinion 8*b* and a second sun wheel 4 in mesh with a planetary gear 8*a*, a display transmission wheel 17 in mesh with a sun wheel pinion 6*c*, a display wheel 18 in mesh with a display transmission pinion 17*b*, a display degree determining pin 9*b* and a planetary transmission wheel 19 in mesh with the ratchet wheel 1 and a second sun gear 4*a*.

However, according to the conventional timepiece with spring winding state display, there pose the following problems.

(1) Gears constituting the planetary gear need a large space in view of the characteristic and the speed reduction ratio cannot be increased. For example, the speed reduction ratio is generally about ½. Accordingly, a plurality of speed reduction gear trains use other than the planetary gear are required.

(2) Therefore, in order to mount a power reserve mechanism to a timepiece, a large space has to be secured in a movement of the timepiece.

(3) Since an angle of reciprocating a hand for displaying of duration time of the timepiece in a fan-like shape, is determined by the speed reduction ratio of the planetary gear and the speed reduction gear trains related thereto and accordingly, the angle of reciprocating the hand in a fan-like shape is difficult to change.

Hence, in order to resolve the above-described problems, objects of the invention reside in points described below.

(1) To reduce a number of parts constituting a timepiece with spring winding state display.

(2) To downsize a movement of a timepiece with spring winding state display.

(3) To realize a timepiece with spring winding state display in which rotation range of a power reserve hand (a hand operating fan angle) can be easily changed.

DISCLOSURE OF INVENTION

In order to resolve the above-described problems, the invention is constituted such that in a timepiece with spring winding state display having a function of displaying a winding state of a spring which constitutes a power source of a mechanical type timepiece comprises a barrel complete having a mainspring, a barrel arbor, a barrel gear and a barrel cover, the barrel gear being constituted to be rotatable only in one direction by rewinding of the mainspring by the barrel gear, a ratchet wheel supported to rotate integrally with the barrel arbor and rotatable only in the same direction as the direction of rotation of the barrel gear, a ratchet wheel rotation regulating member for regulating rotation of the ratchet wheel only in one direction and an intermediate ratchet wheel installed rotatably by the rotation of the ratchet wheel.

Further, the timepiece with spring winding state display according to the invention is constituted to include a planetary reduction wheel gear installed rotatably by rotation of the barrel gear, a planetary wheel installed rotatably to the planetary reduction wheel gear with a center of rotation disposed at a portion different from a center of rotation of the planetary reduction wheel gear and having a first planetary wheel and a second planetary wheel rotatable integrally with the planetary wheel, a first sun wheel installed rotatably with the center of rotation of the planetary reduction wheel gear as a center of rotation and having a first sun wheel gear in mesh with the second planetary wheel, a second sun wheel installed rotatably with the center of rotation of the first sun wheel as a center of rotation and having a second sun wheel gear in mesh with the intermediate ratchet wheel and a second sun wheel pinion in mesh with the first planetary wheel, a sun wheel finger attached to the first sun wheel and having one or more of feeding fingers, an intermediate power reserve wheel installed intermittently rotatably by the feeding fingers, a power reserve jumper for regulating a position in a rotational direction of the intermediate power reserve wheel and a spring winding state display member for displaying a spring winding state based on rotation of the intermediate power reserve wheel.

By such a constitution, when the spring is wound up, the planetary reduction wheel gear operates as a fixed gear in a planetary gear mechanism and the spring winding state display member can display the spring winding state. The spring winding state display member is operated in a fanlike shape.

Further, by such a constitution of the invention using the sun wheel finger, a range in which the power reserve hand can rotate (hand operating fan angle) can easily be changed.

On the other hand, when the spring is rewound (released), the second sun wheel gear operates as a fixed gear in the planetary gear mechanism and the spring winding state display member rotates in a direction opposed to a direction of rotating when the spring is wound up, by which the spring winding state can be displayed. Accordingly, a user can find a durable time period of the timepiece by looking at the hand operating fan angle.

It is preferable to constitute a timepiece with spring winding state display according to the invention to include a power reserve wheel rotating based on rotation of the intermediate power reserve wheel and the power reserve hand attached to the power reserve wheel.

By the constitution, a small-sized timepiece can be realized.

Further, it is preferable to constitute the timepiece with spring winding state display according to the invention such that the first sun wheel includes the first sun wheel gear and a first sun wheel arbor, the second sun wheel is integrated rotatably to the first sun wheel arbor and the sun wheel finger is attached slippably to the first sun wheel arbor.

In an automatic winding timepiece with such constitution, the hand operating fan angle can be restricted and accordingly, the spring winding state can be surely displayed.

Further, it is preferable in the timepiece with spring winding state display according to the invention that the planetary reduction wheel gear is integrated rotatably to the first sun wheel arbor.

By the constitution, a small-sized timepiece can be realized.

Further, it is preferable in the timepiece with spring winding state display according to the invention that a rotational angle regulating member for regulating a range of a rotatable angle of the spring winding state display member is included.

By the constitution, in a mechanical type timepiece, the hand operating fan angle can be restricted to a certain range in correspondence with display signs representing a spring winding state of a dial.

Further, the invention is constituted such that in a timepiece with spring winding state display having a function of displaying a winding state of a spring which constitutes a power source of a mechanical type timepiece, the timepiece with spring winding state display comprises a barrel complete having a mainspring, a barrel arbor, a barrel gear and a barrel cover the barrel gear being constituted to be rotatable only in one direction by rewinding of the mainspring, a ratchet wheel supported to rotate integrally with the barrel arbor and rotatable only in the same direction as the direction of rotation of the barrel gear, a planetary gear mechanism constituted to transmit a rotational speed of the ratchet wheel by changing the rotational speed based on rotation of the ratchet wheel, intermittent rotation transmitting means for intermittently transmitting rotation based on an output from the planetary gear mechanism and spring winding state displaying means for displaying a winding state of the mainspring by intermittently rotating in a first direction based on an output from the intermittent rotation transmitting means, wherein the spring winding state displaying means is constituted to rotate in a second direction opposed to the first direction by the operation of the planetary gear mechanism based on rotation of the barrel gear.

Further, it is preferable in the timepiece of the invention that the intermittent rotation transmitting means is constituted to include one or more of feeding fingers rotating based on the output from the planetary gear mechanism, an intermediate power reserve wheel rotated by rotation of the feeding fingers and an intermediate power reserve wheel rotation regulating member for regulating rotation of the intermediate power reserve wheel.

By the constitution, there can be realized a smallsized timepiece having the spring winding state display device which is easy to see.

Such an intermittent rotation transmitting means according to an embodiment of the invention is constituted by the sun wheel finger and gears. However, the intermittent rotation transmitting means may be constituted by other structure such as Geneva mechanism or the like.

Further, it is preferable in the timepiece of the invention that the feeding fingers are installed such that the feeding fingers can slip relative to the planetary gear mechanism.

By the constitution, in an automatic winding timepiece, the hand operating fan angle can be restricted to a constant range in correspondence with display signs representing a spring winding state of a dial.

BRIEF DESCRIPTION OF THE DRAWINGS

FIG. 6 is a function block diagram of the embodiment of the timepiece with spring winding state display according to the invention in a normal hand operating state.

BEST MODE FOR CARRYING OUT THE INVENTION

An explanation will be given of embodiments of the invention in reference to the drawings as follows.

(1) Constitution of a timepiece with spring winding state display according to the invention.

Figure 1:
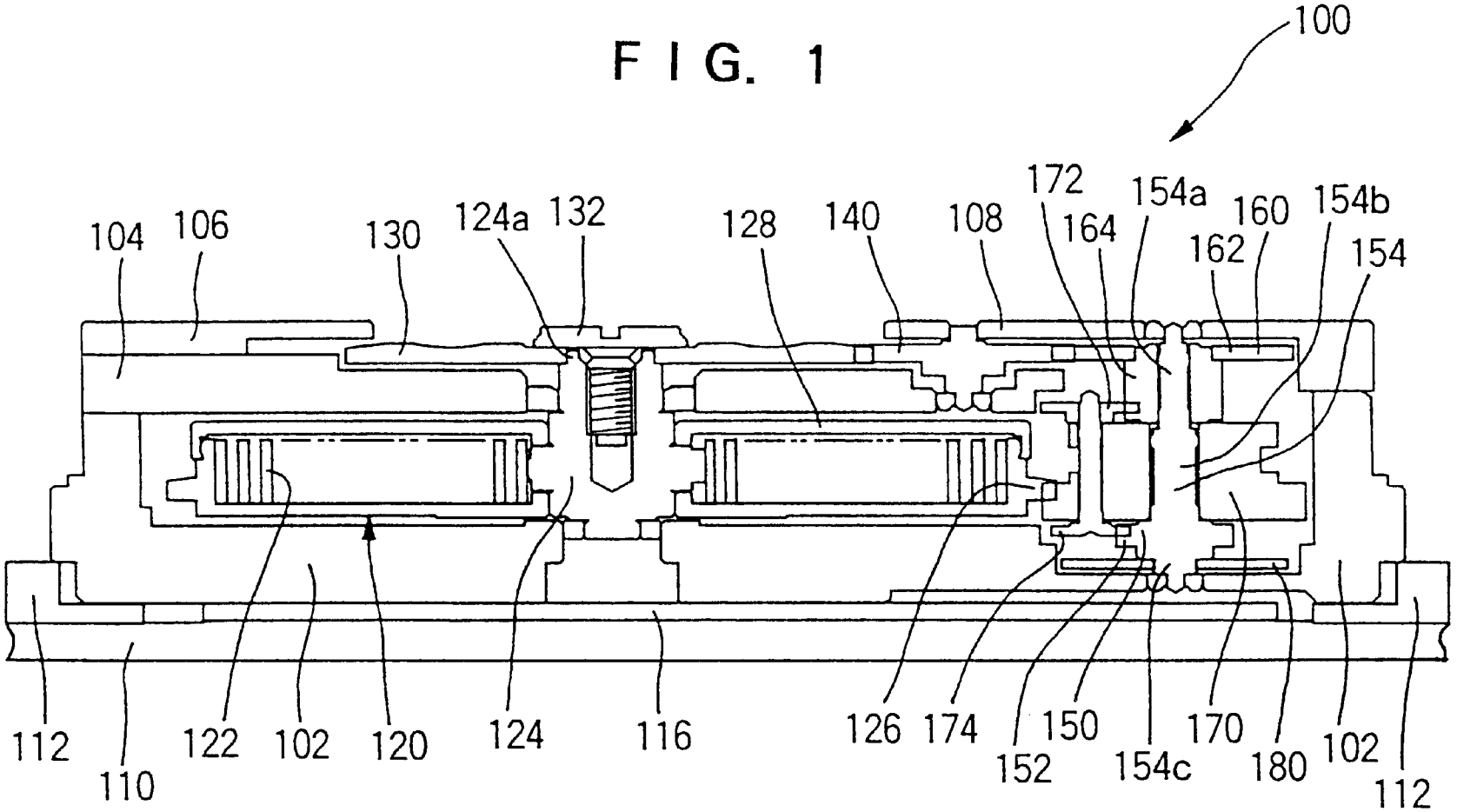
FIG. 1 is a partial sectional view of a movement according to an embodiment of a timepiece with spring winding state display of the invention.
Figure 3:
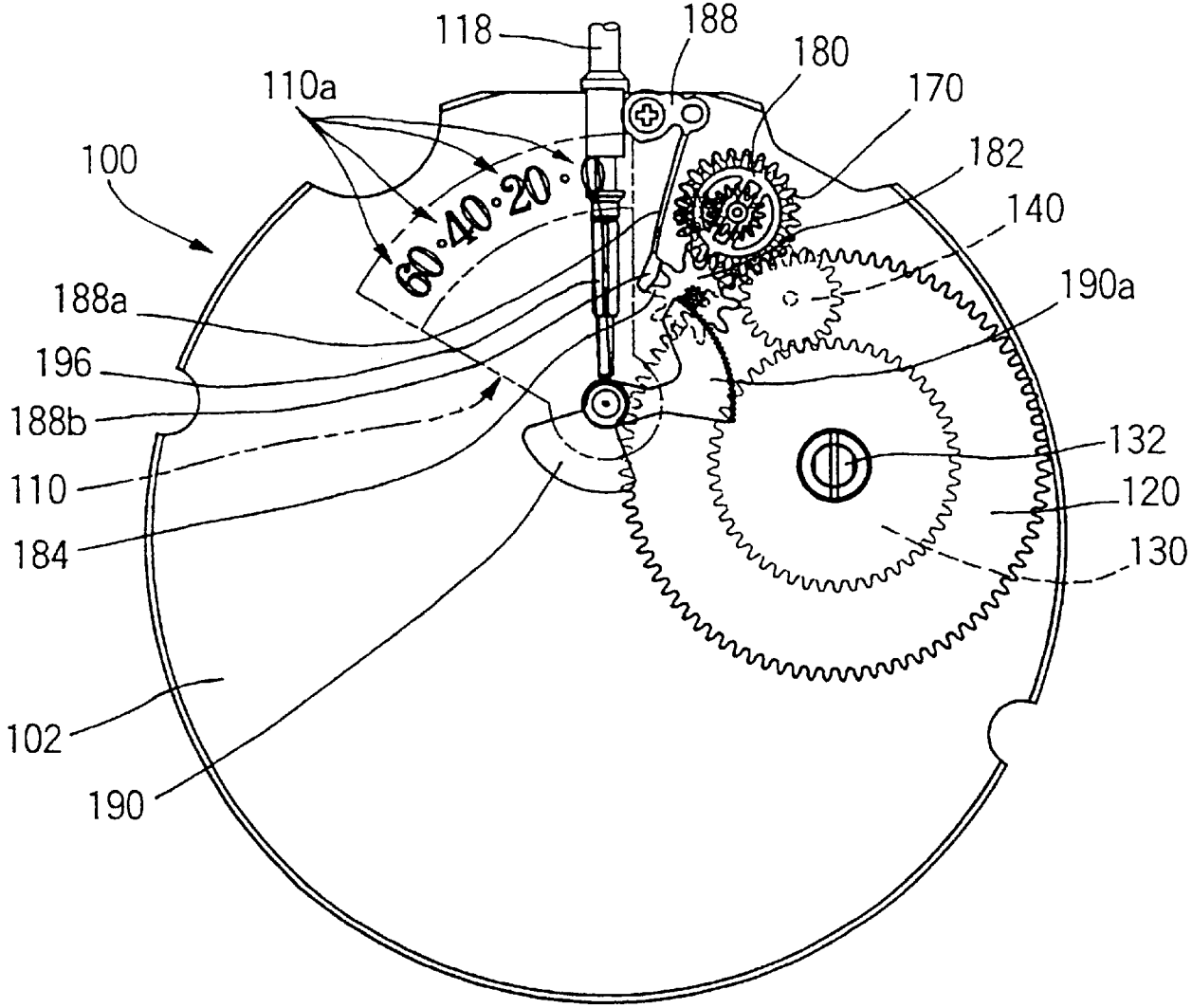
FIG. 3 is a partial plane view of the movement according to the embodiment of the timepiece with spring winding state display of the invention showing the spring in completely rewound state.

In reference to FIG. 1 and FIG. 3, a timepiece with spring winding state display 100 according to the invention is provided with a main plate 102, a barrel bridge 104, a transmission wheel bridge 106 and a third bridge 108.

In this case, a "movement" designates a mechanical body of a timepiece and a "complete" designates a complete entity of a timepiece containing a mechanical body, that is, a movement of a timepiece in a timepiece case. Further, a "rear side" of the main plate 102 indicates a side of both faces of the main plate 102 proximate to glass of the timepiece case and a "surface side" of the main plate 102 indicates a side of the both faces of the main plate 102 remote from the glass of the timepiece case.

A dial 110 is arranged on the rear side of the main plate 102 via a dial support ring 112. A support for dial side parts 114 is arranged between the main plate 102 and the dial 110. A winding stem 118 is integrated to the main plate 102.

A barrel complete 120 is supported rotatably by the barrel bridge 104 and the main plate 102. The barrel complete 120 is provided with a mainspring 122, a barrel arbor 124, a barrel gear 126 and a barrel cover 128. The mainspring 122 constitutes a power source of a mechanical type timepiece. By rewinding (releasing) the mainspring 122, the barrel gear 126 is rotated in one direction and displays time information by hands via rotation of a front side gear train and a rear side gear train. The front side gear train and the rear side gear train are supported rotatably by the main plate 102, the third bridge 108 and a second bridge (not illustrated).

A ratchet wheel 130 is integrated to a square shaft portion 124*a* of the barrel arbor 124 in the barrel complete 120. The ratchet wheel 130 is supported to rotate integrally with the barrel arbor 124 by a ratchet wheel screw 132. The ratchet wheel 130 can be rotated only in the same direction as the direction of rotation of the barrel complete 120.

A click (not illustrated) constituting a member for regulating rotation of the ratchet wheel is provided at the barrel bridge 104 for regulating the ratchet wheel 130 so as to rotate only in one direction. The ratchet wheel 130 is prevented from rotating in a direction opposed to the direction of rotation of the barrel complete 120 by the click.

A hand winding mechanism (not illustrated) and/or an automatic winding mechanism (not illustrated) for winding up the mainspring 122 is attached to the transmission wheel bridge 106. In the case of a timepiece having a hand winding mechanism, the mainspring 122 can be wound up by rotating the ratchet wheel 130 by rotating the winding stem 118.

An intermediate ratchet wheel 140 is supported rotatably to the third bridge 108 and the barrel bridge 104. The intermediate ratchet wheel 140 is in mesh with the ratchet wheel 130 and can be rotated by rotation of the ratchet wheel 130.

A first sun wheel 150 is supported rotatably to the third bridge 108 and the main plate 102. The first sun wheel is provided with a first sun wheel gear 152 and a first sun wheel arbor 154. The first sun wheel arbor 154 includes a first axle portion 154*a*, a second axle portion 154*b* and a third axle portion 154*c* in a direction from the third bridge 108 to the main plate 102. The first sun gear 152 is disposed between the second axle portion 154*b* and the third axle portion 154*c*.

A second sun wheel 160 is integrated rotatably to the first axle portion 154*a* of the first sun wheel arbor 154. That is, the center of rotation of the second sun wheel 160 is the same as the center of rotation of the first sun wheel 150. The second sun wheel 160 is provided with a second sun wheel gear 162 and a second sun wheel pinion 164. The second sun wheel gear 162 is in mesh with the intermediate ratchet wheel 140 and can be rotated by rotation of the intermediate ratchet 140.

A planetary reduction wheel gear 170 is arranged rotatably relative to the second axle portion 154*b* of the first sun wheel arbor 154. That is, the center of rotation of the planetary reduction wheel gear 170 is the same as the center of rotation of the first sun wheel 150. The planetary reduction wheel gear 170 is in mesh with the barrel gear 126 and can be rotated by rotation of the barrel gear 126.

A first planetary wheel 172 is arranged rotatably to the planetary reduction wheel gear 170 with the center of rotation disposed at a portion different from the center of rotation of the planetary reduction wheel gear 170. Further, a second planetary wheel 174 is arranged rotatably to the planetary reduction wheel gear 170 with the center of rotation disposed at a portion different from the center of rotation of the planetary reduction wheel gear 170. The first planetary wheel 172 together with the second planetary wheel 174 constitute a planetary wheel 176 and both are fixed to each other such that the both are rotatably integrally relative to the planetary reduction wheel gear 170. That is, the first planetary wheel 172 is arranged to be able to rotate by being disposed on the surface side of the planetary reduction wheel gear 170 whereas the second planetary wheel 174 is arranged to be able to rotate by being disposed on the rear side of the planetary reduction wheel gear 170.

The first planetary wheel 172 is in mesh with the second sun wheel pinion 164 and thus the first planetary wheel 172 can rotate while revolving around the second sun wheel pinion. The second planetary wheel 174 is in mesh with the first sun wheel gear 152 and thus the second planetary wheel 174 can rotate while revolving around the first sun wheel gear 152. Further, the first planetary wheel 172 and the second planetary wheel 174 are constituted to be able to rotate while revolving integrally.

A sun wheel finger 180 is attached to the third axle portion 154*c* of the first sun wheel arbor 154. The sun wheel finger 180 is provided with two of bridge portions 180*a* and 180*b* and two of feeding fingers 180*c* and 180*d* (refer to FIG. 4). By sandwiching the third axle portion 154*c* between the two bridge portions 180*a* and 180*b*, the sun wheel finger 180 is attached to the third axle portion 154*c* such that the sun wheel finger 180 can be slipped by constant slip torque. The number of the bridge portions may be one or two or more. The number of the feeding fingers may be one or may be two or more. By determining the number of the feeding fingers, a speed reduction ratio of the gear train can be determined.

Figure 2:
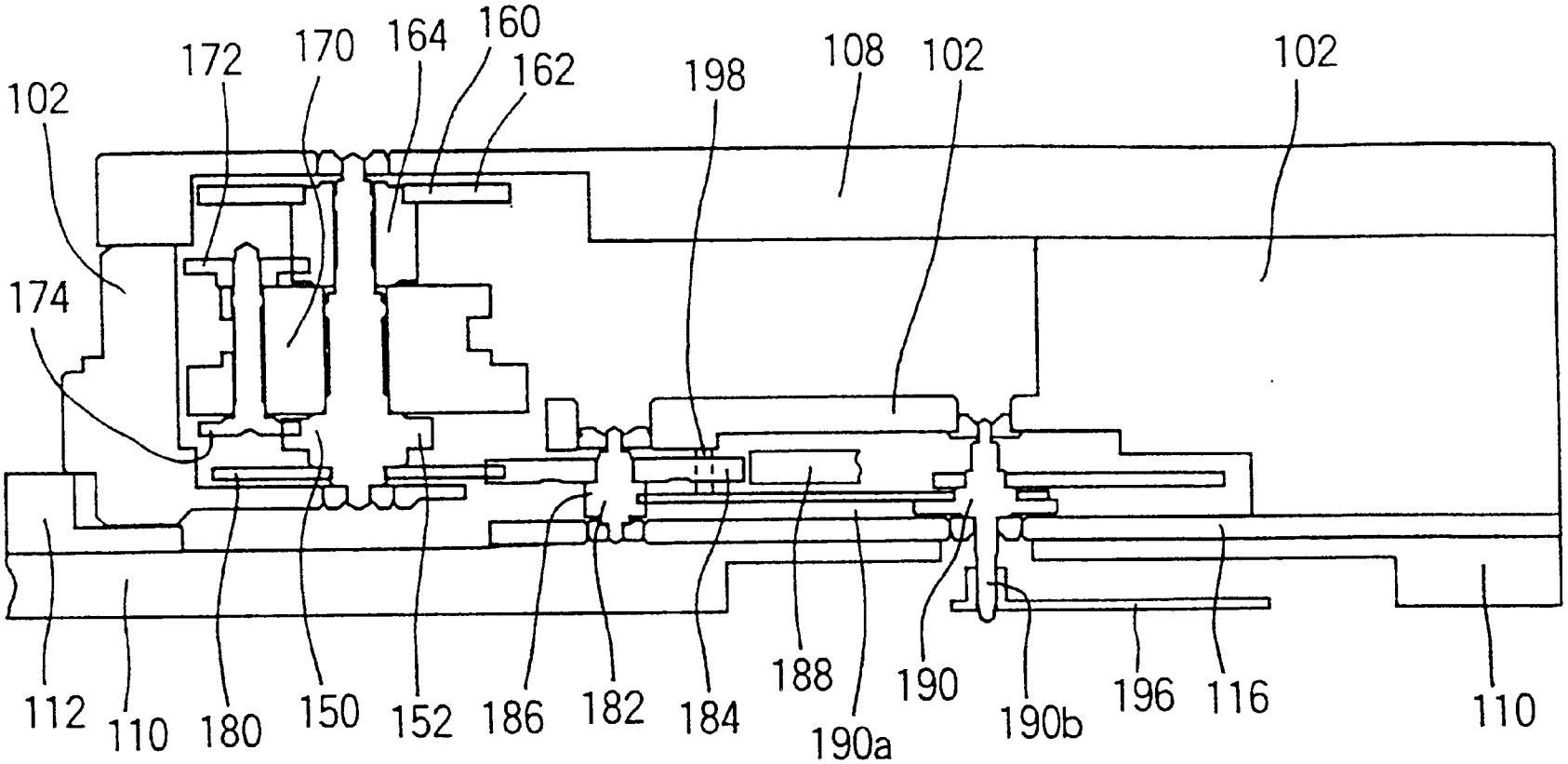
FIG. 2 is a partial sectional view of the movement according to the embodiment of the timepiece with spring winding state display of the invention.

In reference to FIG. 2 and FIG. 3, an intermediate power reserve wheel 182 is supported rotatably to the main plate 102 and the support for dial side parts 116. The intermediate power reserve wheel 182 is provided with an intermediate power reserve wheel gear 184 and an intermediate power reserve wheel pinion 186. The two feeding fingers 180*c* and 180*d* are installed engageably with the intermediate power reserve wheel gear 184 so as to feed the intermediate power reserve wheel gear 184 intermittently. For example, when the intermediate power reserve wheel gear 184 is provided with 10 teeth, by one rotation of the sun wheel finger, the intermediate power reserve wheel gear 184 is fed by an amount of two teeth. Therefore, a speed reduction ratio of the portion is ⅕.

A power reserve jumper 188 for regulating a position in the rotational direction of the intermediate power reserve wheel 182, is arranged between the main plate 102 and the support for dial side parts 116. The power reserve jumper 188 is provided with a power reserve jumper spring portion 188*a* and a power reserve jumper regulation portion 188*b* and the power reserve jumper regulation portion 188*b* regulates the two teeth of the intermediate power reserve wheel gear 184 (refer to FIG. 4).

A power reserve wheel 190 is supported rotatably to the main plate 102 and the support for dial side parts 116. The power reserve wheel 190 is provided with a power reserve wheel gear 190*a* having an opening angle of substantially 60 degree and a power reserve wheel arbor 190*b*. The power reserve wheel gear 190*a* is in mesh with the intermediate power reserve wheel pinion 186 and can be rotated by rotation of the intermediate power reserve wheel pinion 186.

A power reserve hand 196 constituting a member of spring winding state display, is attached to the power reserve wheel arbor 190*b* of the power reserve wheel 190.

Display signs 110*a* for displaying a spring winding state are installed on the dial 110. According to the embodiment of the invention shown in FIG. 3, the display signs 110*a* include numerals of "0", "20", "40" and "60". The winding state of the spring can be displayed by indicating any of the display signs 110*a* by the power reserve hand 196.

A rotational angle regulating member for regulating a range of a rotatable angle of the power reserve wheel 190, that is, a power reserve wheel positioning pin 198 is installed at the main plate 102. When the power reserve wheel 190 is brought into contact with the power reserve wheel positioning pin 198, further rotation of the power reserve wheel 190 is hampered.

Figure 4:
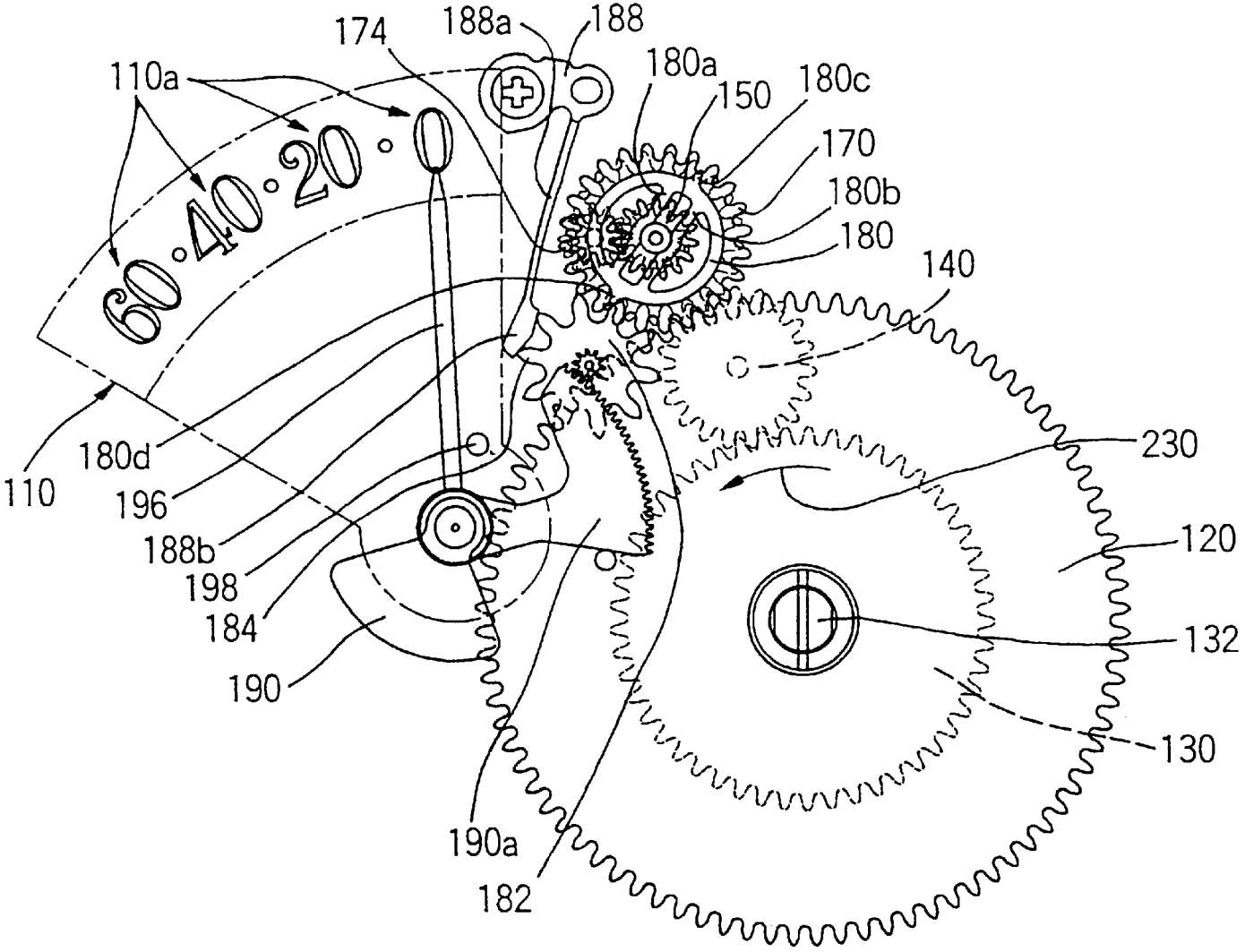
FIG. 4 is an enlarged plane view of a portion of a spring winding state display device of the timepiece with spring winding state display according to the invention showing the spring in completely rewound state.
Figure 5:
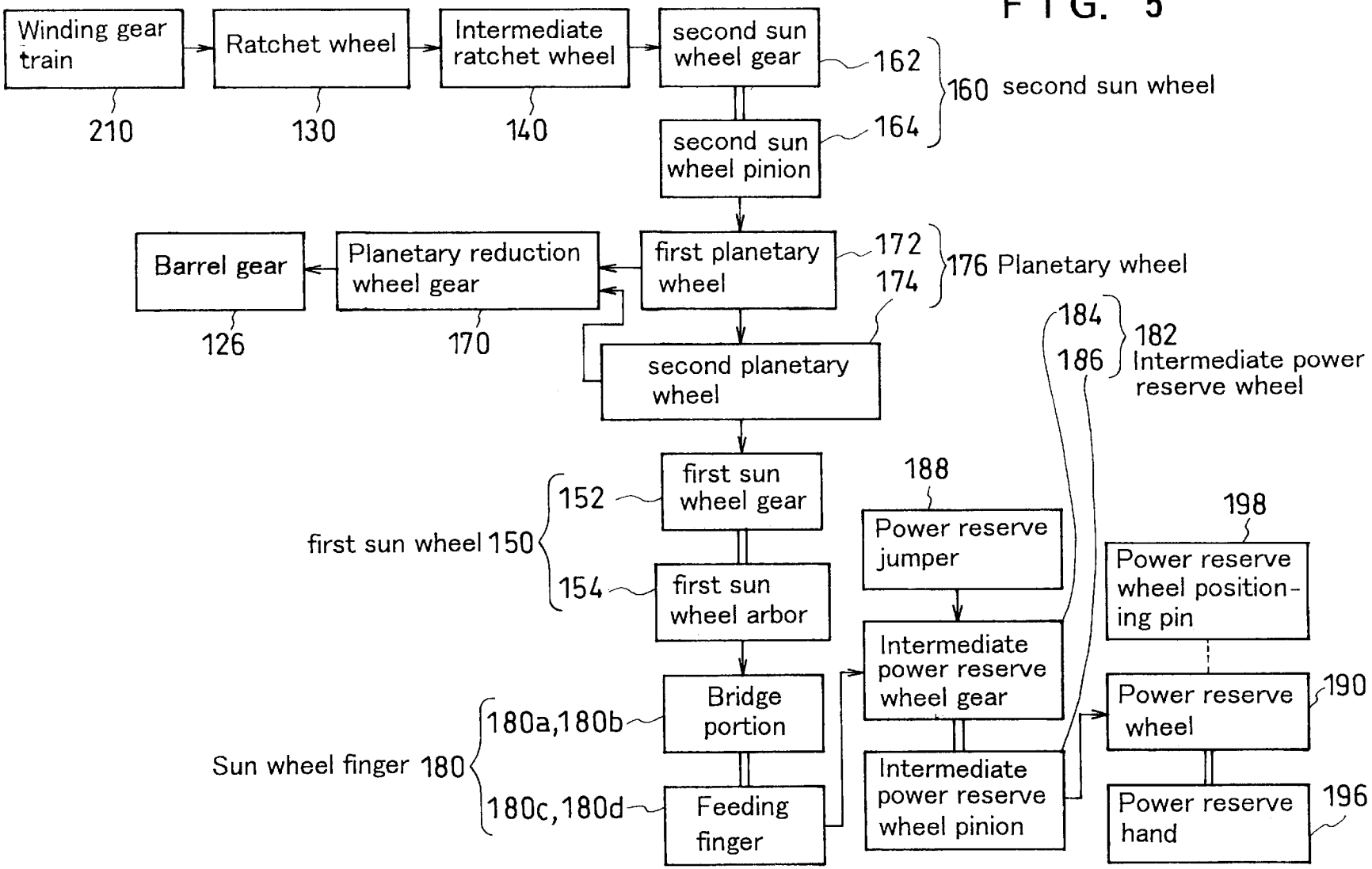
FIG. 5 is a function block diagram of the embodiment of the timepiece with spring winding state display according to the invention showing the spring in wound up state.

(2) Operation of a timepiece with spring winding state display according to the invention (2-1) Operation of winding up a spring In reference to FIG. 4 and FIG. 5, showing the spring is completely rewound, when the ratchet wheel 130 is rotated in the counterclockwise direction (shown by an arrow-mark 230 in FIG. 4) by rotation of the winding gear train 210, the intermediate ratchet wheel 140 is rotated in the clockwise direction.

Under the state, rotation of the planetary reduction wheel gear 170 is regulated by the barrel gear 126 and accordingly, the planetary reduction wheel gear 170 constitutes a "fixed gear" in the planetary gear mechanism.

By rotation of the intermediate ratchet wheel 140, the second sun wheel 160 is rotated in the counterclockwise direction. Rotation of the planetary reduction wheel gear 170 is regulated and accordingly, by rotation of the second sun wheel 160, the first planetary wheel 172 and the second planetary wheel 174 are rotated in the clockwise direction. Rotation of the first planetary wheel 172 and the second planetary wheel 174 is "autorotation" in which the center of rotation is not moved.

By rotation of the second planetary wheel 174, the first sun wheel 150 is rotated in the counterclockwise -direction, while the sun wheel finger 180 is rotated in the counterclockwise direction. By rotation of the sun wheel finger 180, the two feeding fingers 180*c* and 180*d* are operated alternately and cause to rotate intermittently the intermediate power reserve wheel gear 184 in the clockwise direction. By rotation of the intermediate power reserve wheel gear 184, the power reserve wheel 190 is rotated in the counterclockwise direction.

Figure 7:
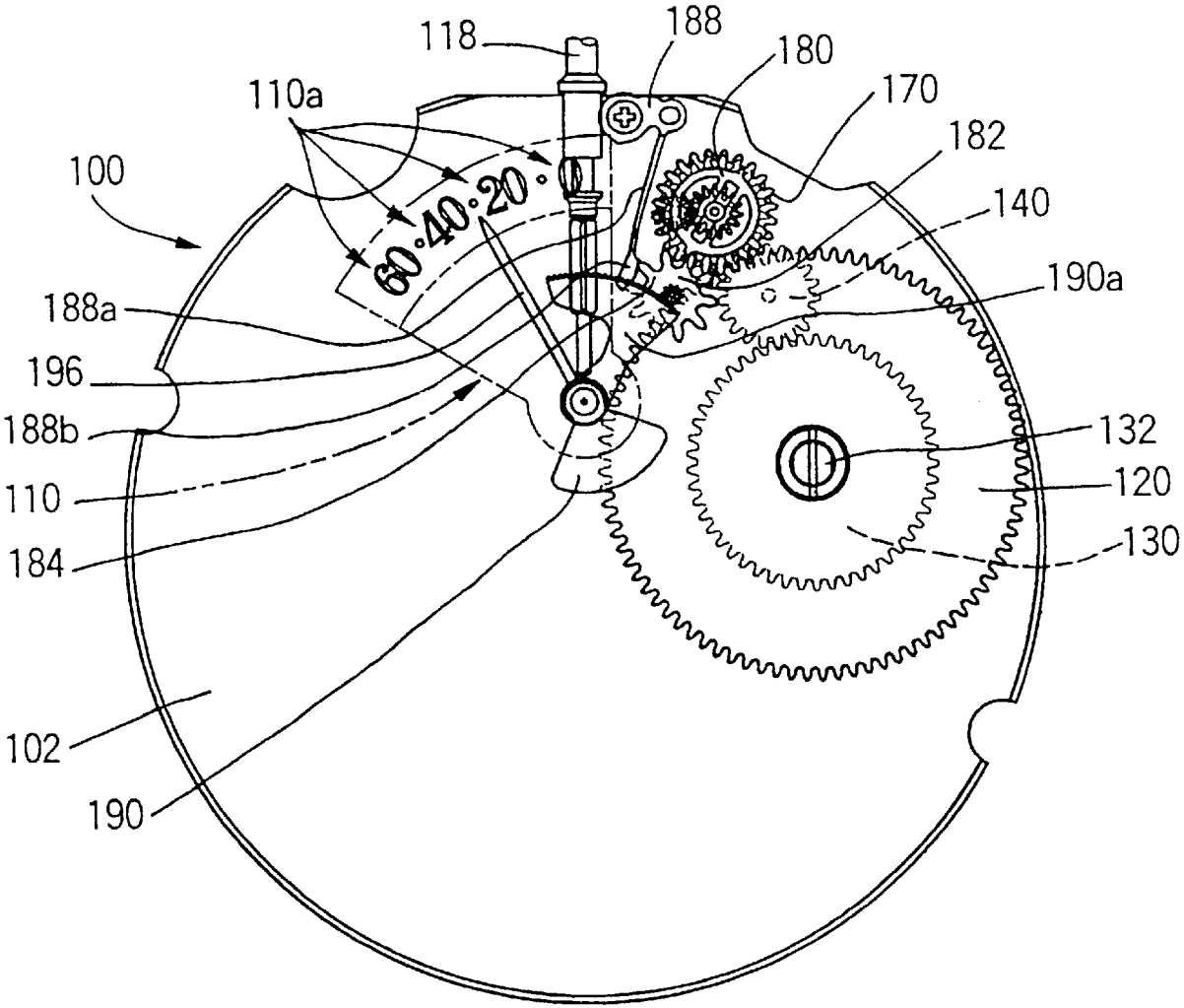
FIG. 7 is a partial plane view of the movement of the embodiment of the timepiece with spring winding state display according to the invention showing the spring in half wound up state.
Figure 8:
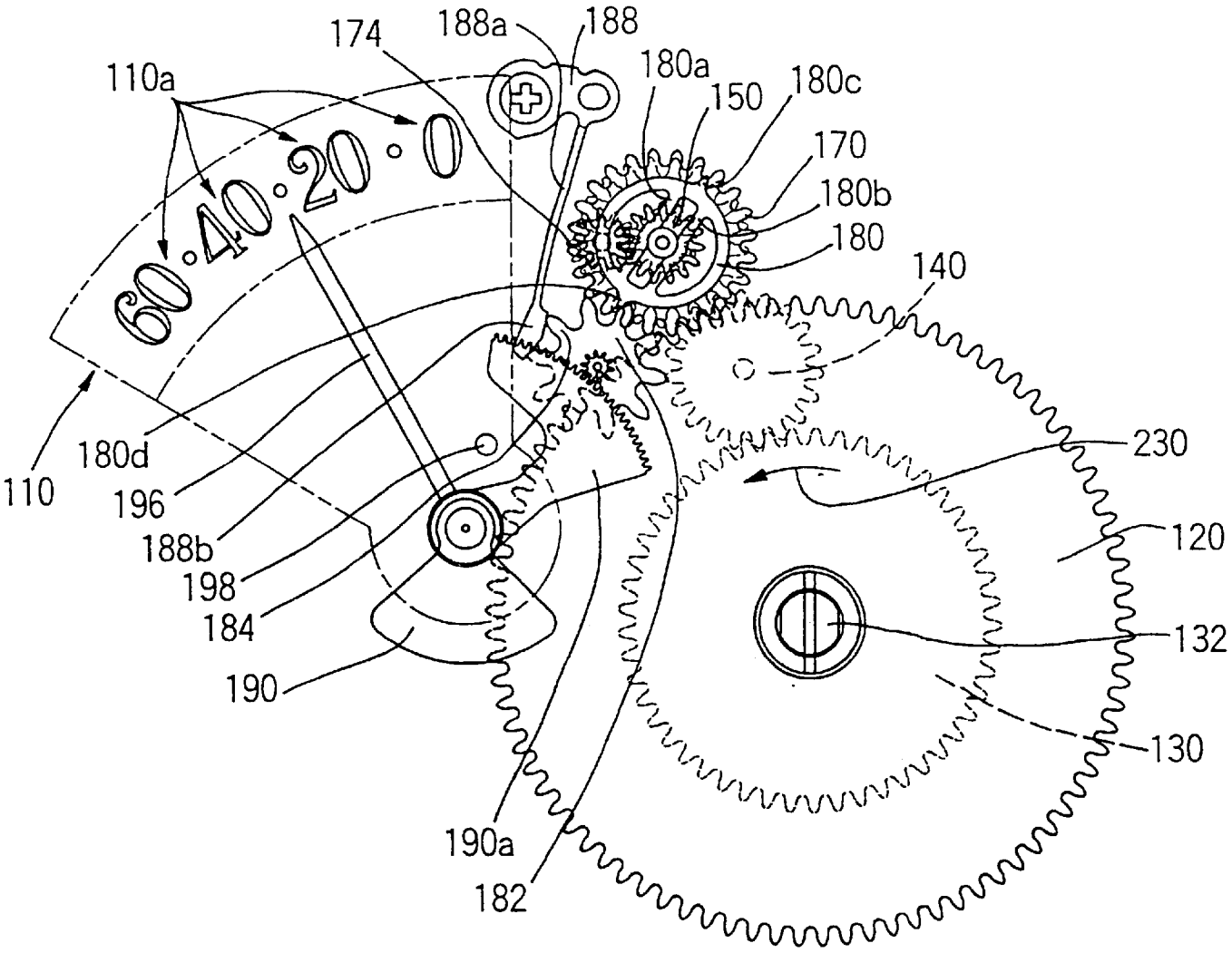
FIG. 8 is an enlarged plane view of a portion of the spring winding state display device of the timepiece with spring winding state display according to the invention showing the spring in half wound up state.
Figure 9:
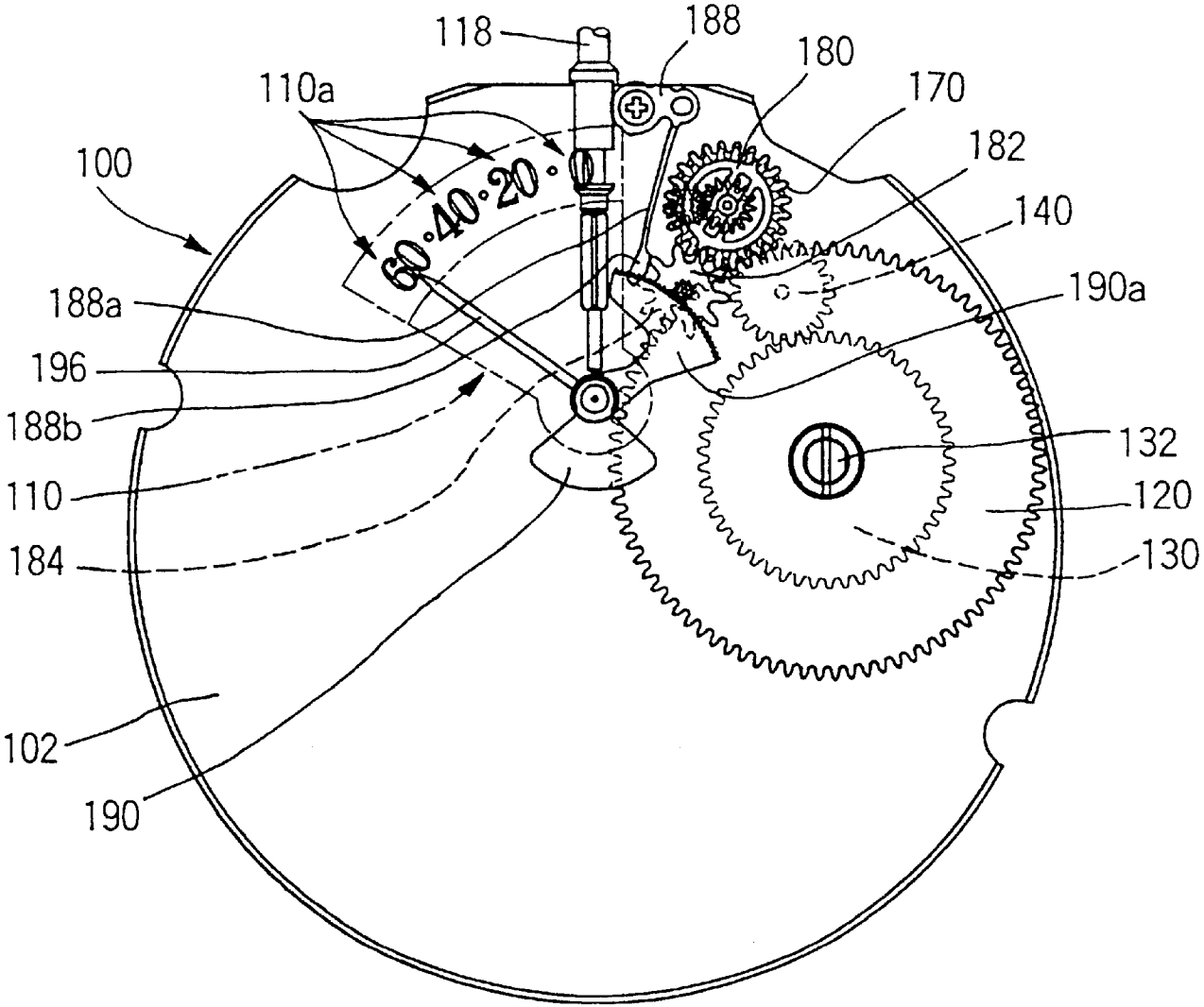
FIG. 9 is a partial plane view of the movement of the embodiment of the timepiece with spring winding state display according to the invention showing the spring is completely wound up.
Figure 10:
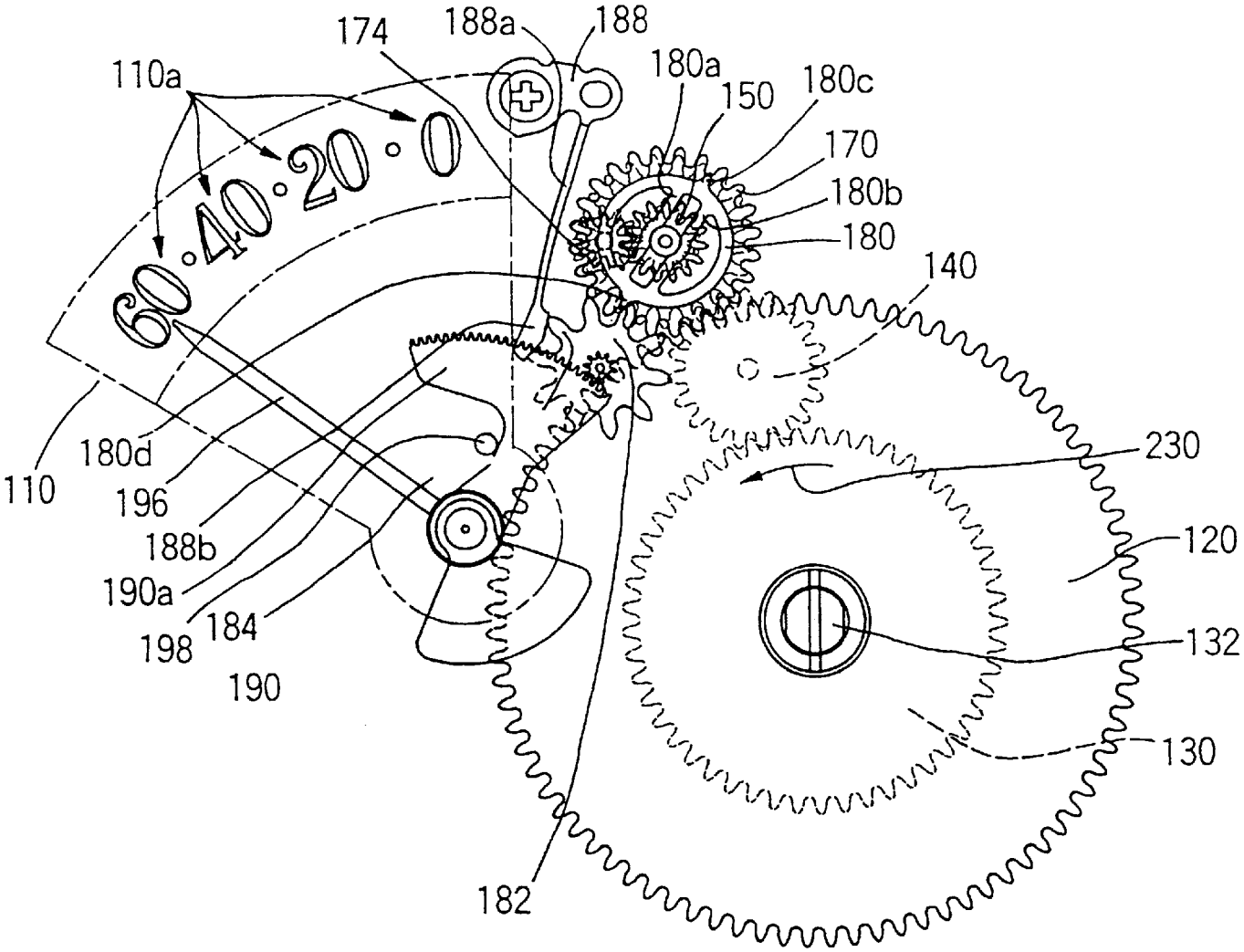
FIG. 10 is an enlarged plane view of the portion of the spring winding state display device of the timepiece with spring winding state display in the state in which the spring is completely wound up.

Therefore, in accordance with winding of the spring, the power reserve hand 196 is rotated in the counterclockwise direction and the state in which the power reserve hand 196 indicates in the display signs 110*a* is shifted from "0" (refer to FIG. 3 and FIG. 4) to "20" then 19 to between "20" and "40" (refer to FIG. 7 and FIG. 8). The states shown in FIG. 7 and FIG. 8 are states in which the spring is "half wound". In accordance with further winding of the spring, the power reserve hand 196 is rotated further in the counterclockwise direction and shifted indicate "60", in the display signs 110*a* after indicating "40" in the display signs 110*a* (refer to FIG. 9 and FIG. 10). Shown in FIG. 9 and FIG. 10 is a state in which the spring is "fully wound".

In the case of a hand winding timepiece, the spring cannot be wound up more than the "fully wound" state of the spring.

On the other hand, in the case of an automatic winding timepiece, when the spring is intended to wind up more than the "fully wound" state of the spring, slippage is caused at a portion of a slipping attachment (not illustrated) installed in the barrel complete 120. In the state in which the slipping attachment slips, the power reserve wheel 190 is brought into contact with the power reserve wheel positioning pin 198, by which the power reserve hand 196 can be prevented from rotating further in the counterclockwise direction.

(2-2) Operation when the hands are normally operated (when the spring is rewound)

In reference to FIG. 6, in the state in which the spring is wound up, the barrel gear 126 is rotated and displays time. In this case, as shown in FIG. 4, the barrel gear 126 is rotated in the counterclockwise direction.

In this state, by operation of a click 212 engaged with teeth of the ratchet wheel 130, rotation of the ratchet wheel 130 is regulated and accordingly, rotation of the intermediate ratchet wheel 140 is regulated and the second sun wheel 160 constitutes a "fixed gear" in the planetary gear mechanism.

By rotation of the barrel gear 126, the planetary reduction wheel gear 170 is rotated in the clockwise direction. Rotation of the second sun wheel 160 is regulated and accordingly, by rotation of the planetary reduction wheel gear 170, the first planetary wheel 172 is rotated while revolving around the second sun wheel pinion 164. The first planetary wheel 172 and the second planetary wheel 174 are integral with each other and accordingly, the second planetary wheel 174 is rotated while revolving around the first sun wheel gear 152.

In this state, the first planetary wheel 172 and the second planetary wheel 174 are rotated in the counterclockwise direction. Rotation of the first planetary wheel 172 and the second planetary wheel 174 is "planetary motion" in which the centers of rotation vary. Accordingly, by the constitution, there can be achieved a speed reduction ratio of a gear train larger than a speed reduction ratio of a normal gear train.

By the planetary motion of the second planetary wheel 174, the first sun wheel 150 is rotated in the clockwise direction, while the sun wheel finger 180 is rotated in the clockwise direction. By rotation of the sun wheel finger 180, two feeding fingers 180*c* and 180*d* are operated alternately and cause to rotate the intermediate power reserve wheel gear 184 intermittently in the counterclockwise direction. By rotation of the intermediate power reserve wheel gear 184, the power reserve wheel 190 is rotated in the clockwise direction.

Accordingly, in accordance with rewinding (releasing) of the spring by rotation of the barrel complete 120, the power reserve hand 196 is rotated in the clockwise direction at a speed slower than a normal rotational speed of the gear train.

Accordingly, the operation shifts from the state in which the power reserve hand 196 indicates "60" in the display signs 110*a* (refer to FIG. 9 and FIG. 10) to the state in which the power reserve hand 196 indicates an intermediary between "40" and "20" in the display signs 110a (refer to FIG. 7 and FIG. 8) via the state in which the power reserve hand 196 indicates "40" in the display signs 110*a*. The state shown by FIG. 7 and FIG. 8 is a "half wound" state of the spring.

In accordance with further rewinding of the spring, the power reserve hand 196 is further rotated in the clockwise direction and shifts to the state in which the power reserve hand 196 indicates "0" in the display signs 110*a* (refer to FIG. 3 and FIG. 4) via the state in which the power reserve hand 196 indicates "20" in the display signs 110*a*. The state shown in FIG. 3 and FIG. 4 is a "winding released" state of the spring.

The display signs 110*a* shown in the drawings of the embodiment of the invention designates operational duration time periods of the timepiece. For example, when the power reserve hand 196 indicates "20", it indicates that the duration time period is 20 hours, and when the power reserve hand 196 indicates "40", it indicates that the duration time period is 40 hours. When the power reserve hand 196 indicates "60", it indicates that the duration time period is 60 hours.

The display signs 110*a* may be constituted such that "1" indicates a "fully wound" state of the spring, "½" indicates a "half wound" state of the spring and "0" indicates a "winding released" state of the spring. Further, the display signs 110*a*. may be constituted such that "*100%*" indicates the "fully wound" state of the spring, "50%" indicates the "half wound" state of the spring and "0%" indicates the "winding released" state of the spring. Alternatively, the display signs 110*a* may be constituted such that "black circle sign" indicates the "fully wound" state of the spring, a "semicircle sign" indicates the "half wound" state of the spring and a "white circle sign" indicates the "winding released" state of the spring.

In reference again to FIG. 6, rotation of the barrel gear 126 rotated by power of the spring is controlled by an adjusting device 240 and an escapement 242. The adjusting device 240 includes a balance wheel (not illustrated). The escapement 242 includes an anchor and an escapement wheel (both are not illustrated).

By rotation of the barrel gear, a front side gear train 244 is rotated. The front side gear train 244 includes a second wheel (or minute wheel), a third wheel, a fourth wheel (and/or second wheel) and so on. The front side gear train 244 is constituted such that a minute hand 246 attached to the second wheel (or minute wheel) constituting the front side gear train 244 displays "minute" and a second hand 248 attached to the fourth wheel (or second wheel) displays "second".

Further by rotation of the front side gear train 244, the back side gear train 250 is rotated. The back side gear train 250 includes a date back side wheel, a cylinder wheel and so on. An hour hand 252 attached to the cylinder wheel displays "hour".

Further, in the case of a timepiece with calendar, the timepiece with calendar may be constituted such that a calendar feeding mechanism 254 is operated based on rotation of the back side gear train 250. The calendar feeding mechanism 254 includes a date indicator, a date indicator claw, a day indicator claw, a date jumper, a day jumper and so on. The calendar feeding mechanism 254 is constituted such that by operating the calendar feeding mechanism 254, the date indicator displays "date" and a day indicator displays "day of week".

Further, the timepiece of the invention is installed with a switching mechanism and a time setting mechanism for setting time of the timepiece and a sunday correcting mechanism for correcting the date indicator 256 and the day indicator 258 (none of them are illustrated).

Figure 11:
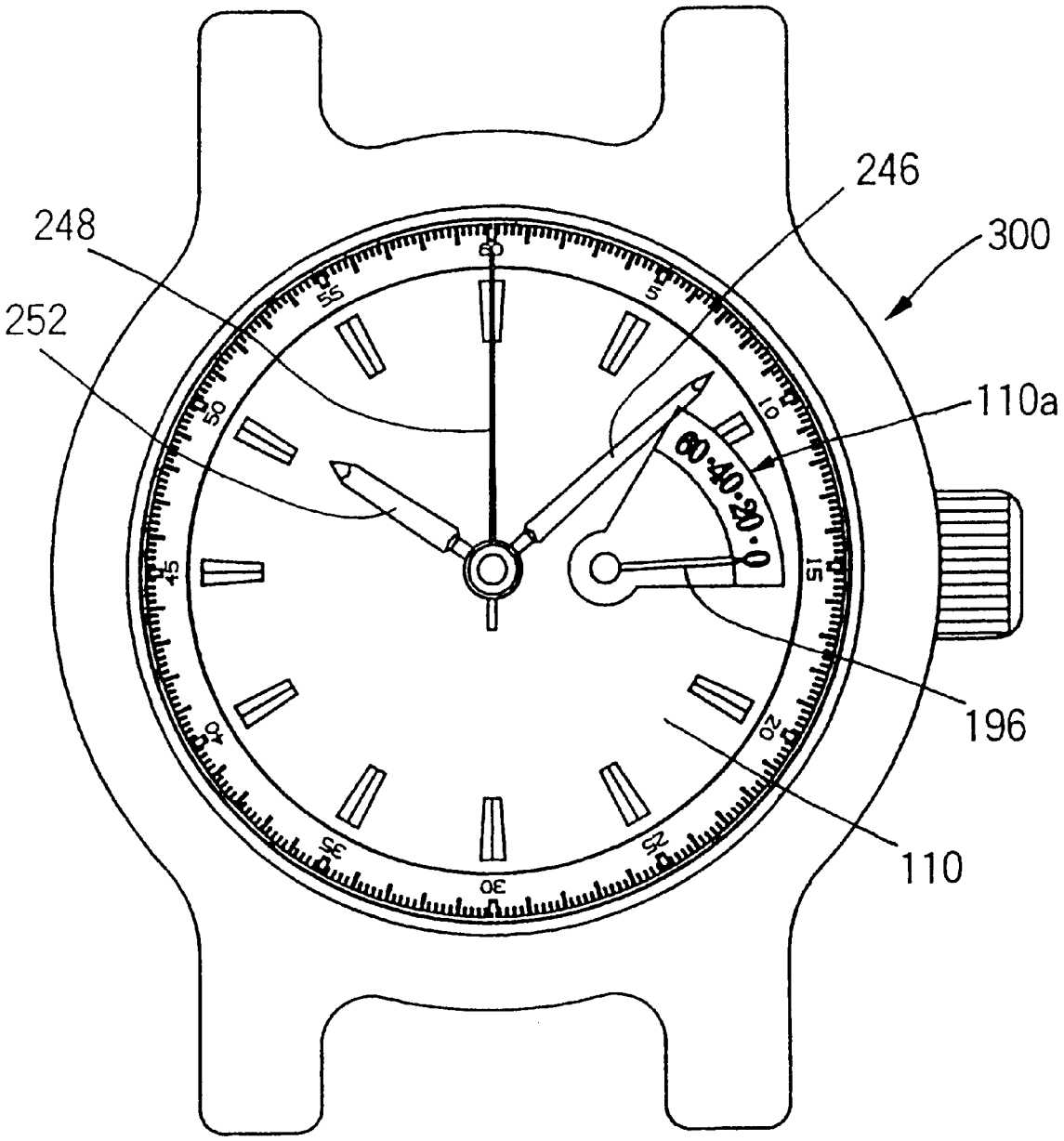
FIG. 11 is a plane view showing an outlook of a complete of a timepiece with spring winding state display according to the invention in the state in which the spring is completely wound up.

(2) An explanation of a complete of the timepiece with spring winding state display according to the invention In reference to FIG. 11, a complete of the timepiece with spring winding state display according to the invention includes a timepiece case 300 in which movement of the timepiece with spring winding state display of the invention is contained.

Time of "hour", "minute" and "second" is displayed by the hour hand 252, the minute hand 246 and the second hand 248.

The display signs 110*a* installed on the dial indicate operable duration time period of the timepiece. In FIG. 11, the power reserve hand 196 indicates "0" in the display signs 110*a*. The state shown by FIG. 11 indicates the "winding released" state of the spring and indicates that ax the duration time period of the timepiece at the current time is 0 hour.

The power reserve hand 196 is constituted to direct in "o'clock direction" of the timepiece in the "rewound" state of the spring. An angle of rotating the power reserve hand 96 from the "rewound" state of the spring is constituted to correspond to the duration time period of the timepiece.

Figure 12:
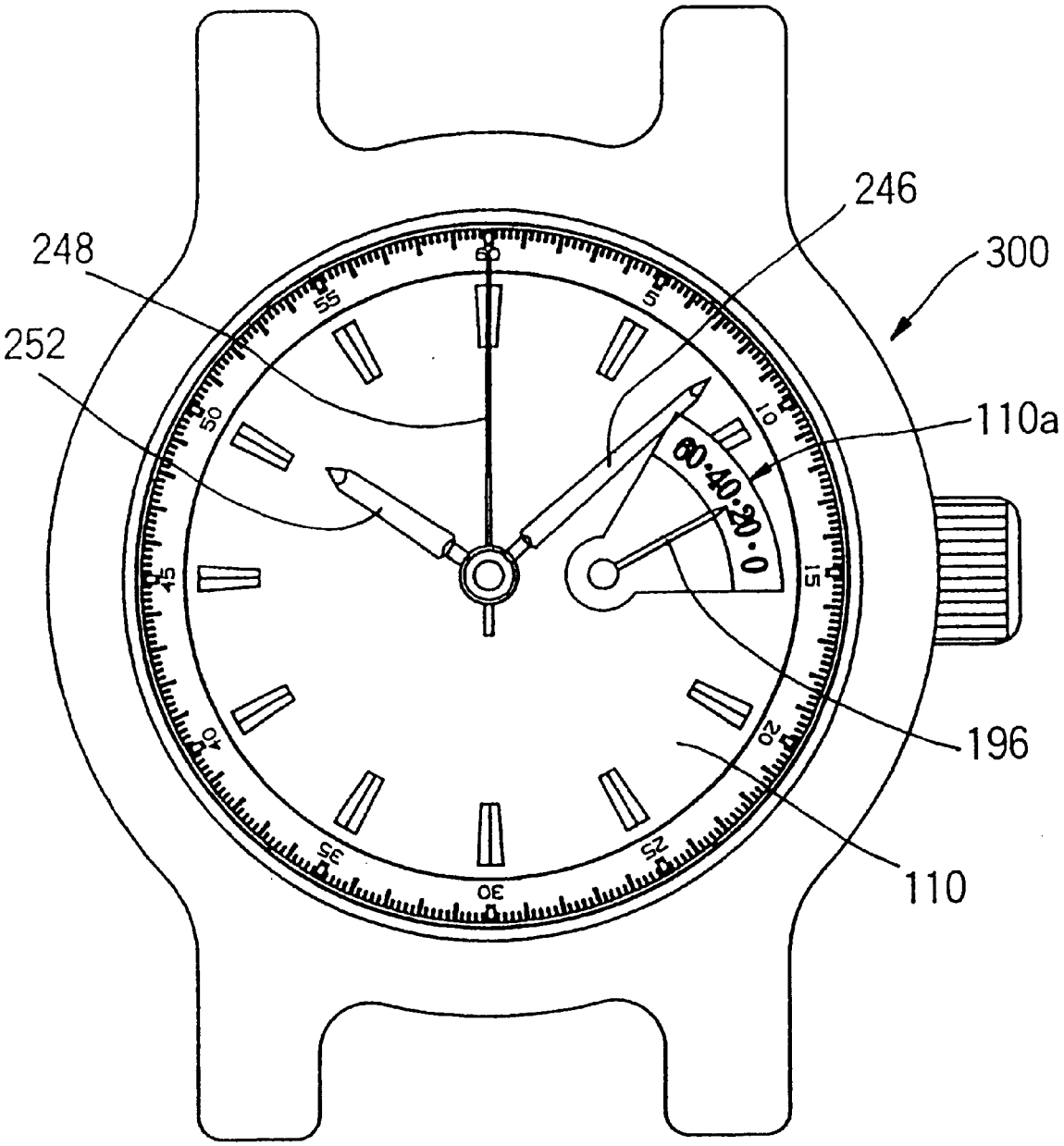
FIG. 12 is a plane view showing the outlook of the complete of the timepiece with spring winding state display according to the invention showing the spring is half wound up.

In FIG. 12, the power reserve hand 196 indicates an intermediary between "20" and "40" of the display signs 110*a*. The state shown by FIG. 12 indicates the "half wound" state of the spring and the duration time period of the timepiece at the current time is about 30 hours. The angle of rotating the power reserve hand 196 from the state shown by FIG. 11 to the state shown by FIG. 12 is about 30 degrees which correspond to about 30 hours of the duration time period.

Figure 13:
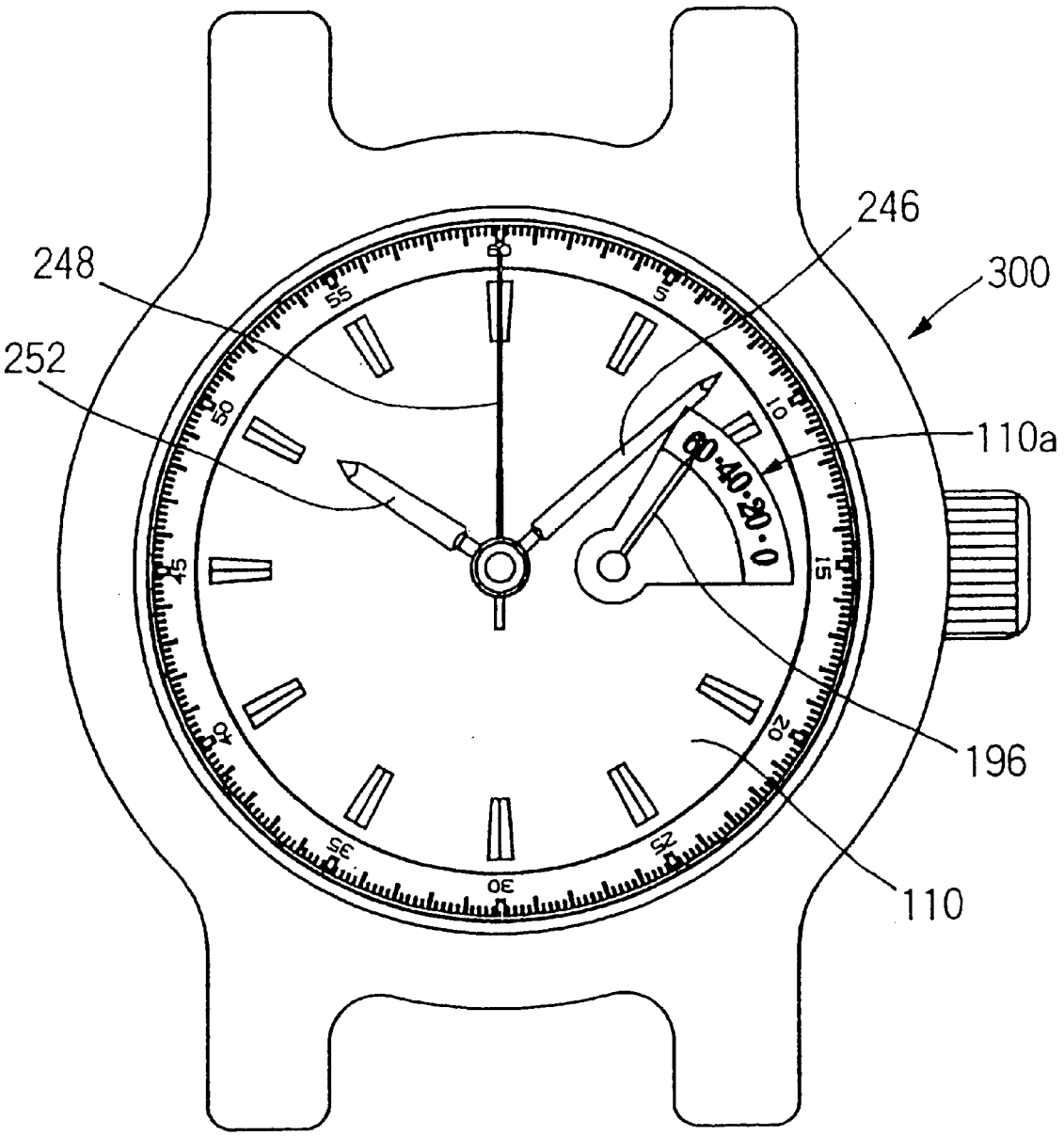
FIG. 13 is a plane view showing the outlook of the complete of the timepiece with spring winding state display according to the invention in the state in which the spring is completely wound up.
Figure 14:
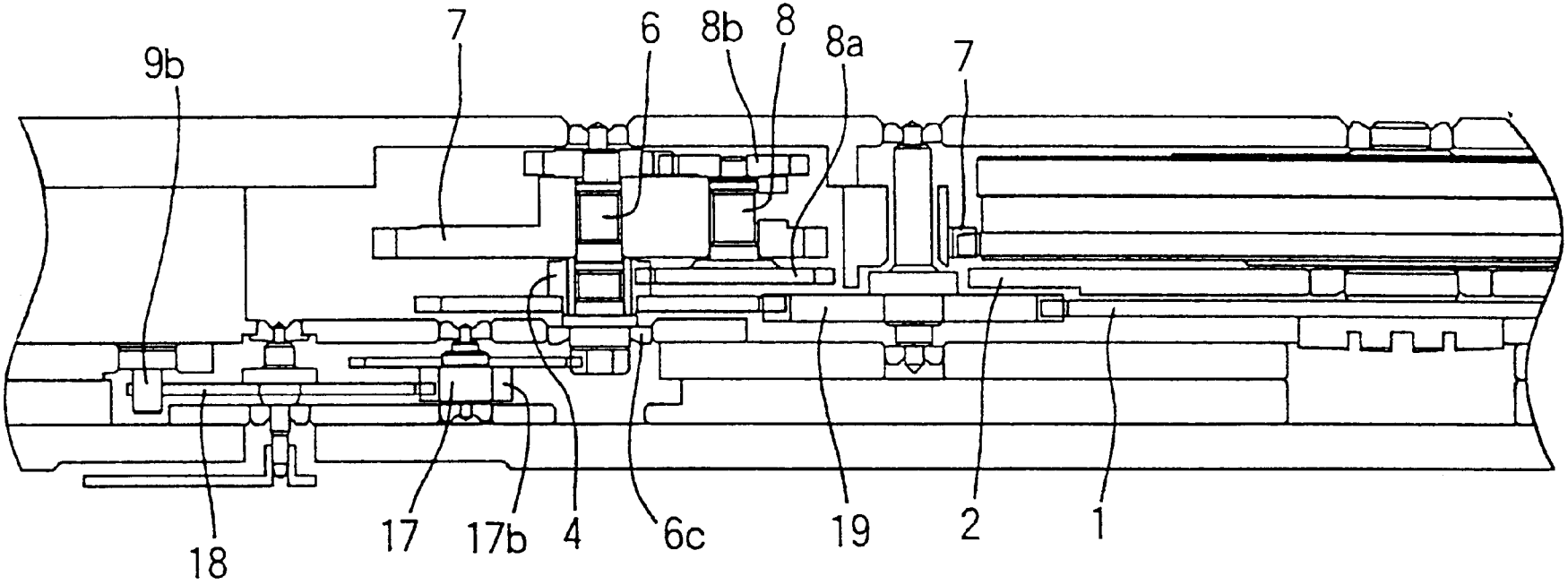
FIG. 14 is a partial sectional view of a conventional timepiece with spring winding state display.

In FIG. 13, the power reserve hand 196 indicates "60" in the display signs 110*a*. The state shown by FIG. 13 shows the "fully wound" state of the spring and the duration time period of the timepiece at the current time is about 60 hours. An angle of rotating the power reserve hand 196 from the state shown by FIG. 11 to the state shown by FIG. 13 is about 60 degrees which correspond to about 60 hours of the duration time period.

Accordingly, the timepiece with spring winding state display according to the invention can display the duration time period of the timepiece in a manner which is very easy to understand. [Embodiment]

An embodiment of a timepiece with spring winding state display according to the invention illustrated here as one example of implementing the invention, is constituted by conditions shown below.

Number of teeth of the barrel gear 126: 84

Number of teeth of the ratchet wheel 130: 49

Number of teeth of the intermediate ratchet wheel 140: 19

Number of teeth of the first sun wheel gear 152: 15

Number of teeth of the second sun wheel gear 162: 21

Number of teeth of the second sun wheel pinion 164: 12

Number of teeth of the planetary reduction wheel gear 170: 24

Number of teeth of the first planetary wheel 172: 12

Number of teeth of the second planetary wheel 174: 9

Number of fingers of the sun wheel finger 180: 2

Number of teeth of the intermediate power reserve wheel gear 184: 10

Number of teeth of the intermediate power reserve wheel pinion 186: 10

Number of teeth of the power reserve wheel gear 190*a* (when teeth are provided over the whole periphery): 144

Number of teeth of the power reserve wheel gear 190*a* (number of teeth of necessary portion shown in the drawing): 26

Accordingly, the speed reduction ratio from the barrel gear 126 to the power reserve wheel 190 is 7/360.

Further, according to the timepiece with spring winding state display of the invention, by changing the number of teeth of the gears mentioned above and/or the number of fingers of the sun wheel finger, content of display of the spring wound state can be changed. Further, by changing the above-described speed reduction ratio, the angle of rotation of the power reserve hand 196 based on rotation of the barrel gear 126 can be changed.

For example, when the number of fingers of the sun wheel finger is set to one, the speed reduction ratio from the barrel gear 126 to the power reserve wheel 190 can be set to 7/720. According to the constitution, when a spring the same spring as used in the above-described embodiment of the invention is used, the rotational angle of the power reserve wheel 190 corresponding to the shift from the winding released state to the fully wound state of the spring is about 30 degrees.

Further, when the number of fingers of the sun wheel finger is set to three, the speed reduction ratio from the barrel gear 126 to the power reserve wheel 190 can be set to 7/240. Under the constitution, when a spring the same as the spring used in the above-described embodiment of the invention is used, the rotational angle of the power reserve wheel 190 in correspondence with from the winding released state to the fully wound state of the spring becomes about 90 degrees.

Industrial Applicability

As has been explained above, the invention is constituted as mentioned above in the timepiece with spring winding state display and accordingly, there are achieved effects described below.

(1) The number of gear trains constituting the spring winding state display device can be reduced. Therefore, the number of parts constituting the timepiece can be reduced and an efficiency of using a space of the movement can be promoted.

(2) The movement of the timepiece can be downsized.

(3) By changing the number of fingers of the sun wheel finger included in the spring winding state display device, a range in which the power reserve hand can rotate (hand operating fan angle) can be changed. Accordingly, the device can correspond with display of various shapes.

What is claimed is:

1. A timepiece with spring winding state display having a function of displaying a winding state of a spring which constitutes a power source of a mechanical type timepiece, said timepiece with spring winding state display comprising:

a barrel complete (120) having a mainspring (122), a barrel arbor (124), a barrel gear (126) and a barrel cover (128), said barrel gear (126) being constituted to be rotatable only in one direction by rewinding of the mainspring (122);

a ratchet wheel (130) supported to rotate integrally with the barrel arbor (124) and rotatable only in one and the same direction as the direction of rotation of the barrel gear (126);

a ratchet wheel rotation regulating member (212) for regulating rotation of the ratchet wheel (130) only in one direction;

an intermediate ratchet wheel (140) installed rotatably by the rotation of the ratchet wheel (130);

a planetary reduction wheel gear (170) installed rotatably by rotation of the barrel gear (126);

a planetary wheel (176) installed rotatably to the planetary reduction wheel gear (170) with a center of rotation disposed at a portion different from a center of rotation of the planetary reduction wheel gear (170) and having a first planetary wheel (172) and a second planetary wheel (174) rotatable integrally with the planetary wheel (176);

a first sun wheel (150) installed rotatably with the center of rotation of the planetary reduction wheel gear (170) as a center of rotation, having a first sun wheel gear in mesh with the second planetary wheel (174);

a second sun wheel (160) installed rotatably with the center of rotation of the first sun wheel (150) as a center of rotation and having a second sun wheel gear (162) in mesh with the intermediate ratchet wheel (140) and a second sun wheel pinion (164) in mesh with the first planetary wheel (172);

a sun wheel finger (180) attached to the first sun wheel (150) and having one or more of feeding fingers **(180*c*, 180*d*)**;

an intermediate power reserve wheel (182) installed intermittently rotatably by the feeding fingers **(180c, 180*d*)**;

a power reserve jumper (188) for regulating a position in a rotational direction of the intermediate power reserve wheel (182); and a spring winding state display member (196) for displaying a spring winding state based on rotation of the intermediate power reserve wheel (182).

2. The timepiece with spring winding state display according to claim 1, characterizing in further comprising:

a power reserve wheel (190) rotated based on rotation of the intermediate power reserve wheel (182); and a power reserve hand (196) attached to the power reserve wheel (190).

3. The timepiece with spring winding state display according to claim 1 or claim 2, characterized in that the first sun wheel (150) includes the first sun wheel gear (152) and a first sun wheel arbor (154);

the second sun wheel (160) is integrated rotatably to the first sun wheel arbor(154); and the sun wheel finger (180) is attached slippably to the first sun wheel arbor (154).

4. The timepiece with spring winding state display according to claim 3, characterized in that the planetary reduction wheel gear (170) is integrated rotatably to the first sun wheel arbor (154).

5. The timepiece with spring winding state display according to claim 1, characterized in including a rotational angle regulating member (198) for regulating a range of a rotatable angle of the spring winding state display member (196).

6. A timepiece with spring winding state display having a function of displaying a winding state of a spring which constitutes a power source of a mechanical type timepiece, said timepiece with spring winding state display comprising:

a barrel complete (120) having a mainspring (122), a barrel arbor (124), a barrel gear (126) and a barrel cover (128), the barrel gear (126) being constituted to be rotatable only in one direction by rewinding of the mainspring (122);

a ratchet wheel (130) supported to rotate integrally with the barrel arbor (124) and rotatable only in the same direction as the direction of rotation of the barrel gear (126);

a planetary gear mechanism (150, 160, 170, 176) constituted to transmit a rotational speed of the ratchet wheel (130) by changing the rotational speed based on rotation of the ratchet wheel (130);

intermittent rotation transmitting means (180) for intermittently transmitting rotation based on an output from the planetary gear mechanism (150, 160, 170, 176); and spring winding state displaying means (196) for displaying a winding state of the mainspring (122) by intermittently rotating in a first direction based on an output from the intermittent rotation transmitting means (180);

wherein the spring winding state displaying means (196) is constituted to rotate in a second direction opposed to the first direction by the operation of the planetary gear mechanism (150, 160, 170, 176) based on rotation of the barrel gear (126).

7. The timepiece with spring winding state display according to claim 6, characterized in that the intermittent rotation transmitting means (180) includes one or more of feeding fingers (180*c*, 180*d*) rotating based on the output from the planetary gear mechanism (150, 160, 170, 176), an intermediate power reserve wheel (182) rotated by rotation of the feeding fingers (180*c*, 180*d*) and an intermediate power reserve wheel rotation regulating member (188) for regulating rotation of the intermediate power reserve wheel (182).

8. The timepiece with spring winding state display according to claim 7, characterized in that the feeding fingers (180*c*, 180*d*) are installed to be able to slip relative to the planetary gear mechanism (150, 160, 170, 176).

* * * * *